United States Patent [19]

Moretti

[11] 4,271,833

[45] Jun. 9, 1981

[54] VENTILATING SYSTEM FOR PROTECTIVE CLOTHING

[75] Inventor: Anthony L. Moretti, San Rafael, Calif.

[73] Assignee: E. D. Bullard Company, Sausalito, Calif.

[21] Appl. No.: 51,615

[22] Filed: Jun. 25, 1979

[51] Int. Cl.[3] ..... A62B 17/00

[52] U.S. Cl. ..... 128/201.29; 128/201.28; 2/DIG. 1

[58] Field of Search ..... 128/201.29, 201.24, 128/201.25, 202.27, 201.27, 402, 201.22, 201.28, 202.11, 202.19; 55/276, 380; 181/224, 258, 292; 2/2.1 A, DIG. 1, 2.5, 7

[56] References Cited

U.S. PATENT DOCUMENTS

| | | | |
|---|---|---|---|
| 3,291,126 | 12/1966 | Messick | 128/201.29 |
| 4,052,984 | 10/1977 | Brockway | 128/201.23 |
| 4,127,130 | 11/1978 | Naysmith | 128/201.25 |

OTHER PUBLICATIONS

Jolley, Jr. et al., An Improved Airline-Type Supplied-Air Plastic Suit, Jun. 1978, Du Pont Literature DPSPU-78-30-12.

30CFR Title 30, Subpart J, pp. 43-44.

E. D. Bullard Co. Product Literature: "System 999".

3M Co. Product Literature, "W-2810" and Economy Systems.

*Primary Examiner*—Henry J. Recla

*Attorney, Agent, or Firm*—Phillips, Moore, Weissenberger, Lempio & Majestic

[57] ABSTRACT

A ventilating system for use with protective clothing of the type including a head enclosure and an outer covering for a user's body is described. The system provides for the distribution of air from a pressurized source to a user's limbs to provide a flow of air thereabout while insuring that sufficient pressurized air is delivered to the head enclosure for respiration and to maintain a positive pressure plenum therein under all conditions.

5 Claims, 3 Drawing Figures

VENTILATING SYSTEM FOR PROTECTIVE CLOTHING

BACKGROUND OF THE INVENTION

1. Field of the Invention

This invention relates to a ventilating system for use with protective clothing of the type including a head enclosure and more particularly to the provision in such a system of a flow of air to the limbs.

2. Prior Art

Health and safety considerations dictate that persons working in atmospheres contaminated with airborne substances of a hazardous nature wear a head enclosing hood, the interior of which is supplied with a positive pressure plenum of pure air for respiration therein. Regardless of the temperature of the atmosphere, the rest of the person's body must at least be clothed with normal working or street wear. However, many working atmospheres are contaminated with airborne substances which are hazardous not just from breathing of the atmosphere, but also from skin contact therewith. Under these conditions, it is desirable that protective clothing be worn which includes not just a head enclosing hood, but which also includes various outer coverings which substantially enclose a person's body so that no skin is exposed. Protective clothing may be relatively specialized, but it frequently includes both inner garments and an outer coverall. Gloves and boots are usually connected to the inner or outer coveralls. The outer coveralls are frequently designed to be disposable after use.

The outer and inner coveralls such as described above may be made of woven or knitted fabric. Fabric resists tearing, punctures and the like when the user is working. Fabric also permits a reasonable amount of perspirative evaporation therethrough. Nevertheless, a person working with such protective clothing tends to become quite warm. Further, there exists some risk of contact with airborne contaminants, as airborne contaminants may enter the body covering at the extremities of the user's limbs or pass through the outer coveralls, proceed through the inner coveralls, and contact the user's skin. Outer coveralls may also be made of relatively light-weight, non-porous material. However, such non-porous materials become very warm under working conditions and there exists some risk of contact with airborne contaminants entering the body covering at the extremities of the user's limbs.

It is an object of this invention to provide an air flow to a user's limbs for ventilation of an outer body covering, the ventilation cooling the user's body by flowing about the extremities thereof and tending to exert a slight positive pressure interior of the outer covering to prevent the entry of contaminants therein.

It is a further object of the present invention that such ventilation be provided while attenuating the sound thereof.

It is yet another object of the present invention that such ventilation be part of an air delivery system which delivers air to a user's head enclosure, the head enclosure receiving pressurized air within a predetermined range of air volume per unit time regardless of the conditions under which the user's body is being ventilated.

SUMMARY OF THE INVENTION

This invention provides a ventilating system for use with protective clothing of the type including an outer covering for the limbs of a user's body. The ventilating system comprises a plurality of flexible conduits, each being connectable at one end to a source of pressurized air, the other end of each conduit being adapted for mounting on a different one of a user's limbs interior the outer covering. The ventilating system may include a head protective covering and a manifold. The manifold has an air inlet and a plurality of air outlets. The air outlets include a first air outlet and a plurality of second air outlets. The first air outlet is connectable to the head protective enclosure and is of a construction sufficient, with respect to the air inlet and second air outlets, to deliver pressurized air within a predetermined range of air volume per unit time therefrom regardless of the air flow through the second air outlets when the air inlet is connected to a source of pressurized air within a predetermined pressure range. Each of the second air outlets are connectable to a respective second conduit.

BRIEF DESCRIPTION OF THE DRAWINGS

The foregoing and other objects and features of this invention will be more clearly understood from a reading of the following specification with reference to the accompanying drawings wherein.

DESCRIPTION OF THE PREFERRED EMBODIMENTS

Figure 1:
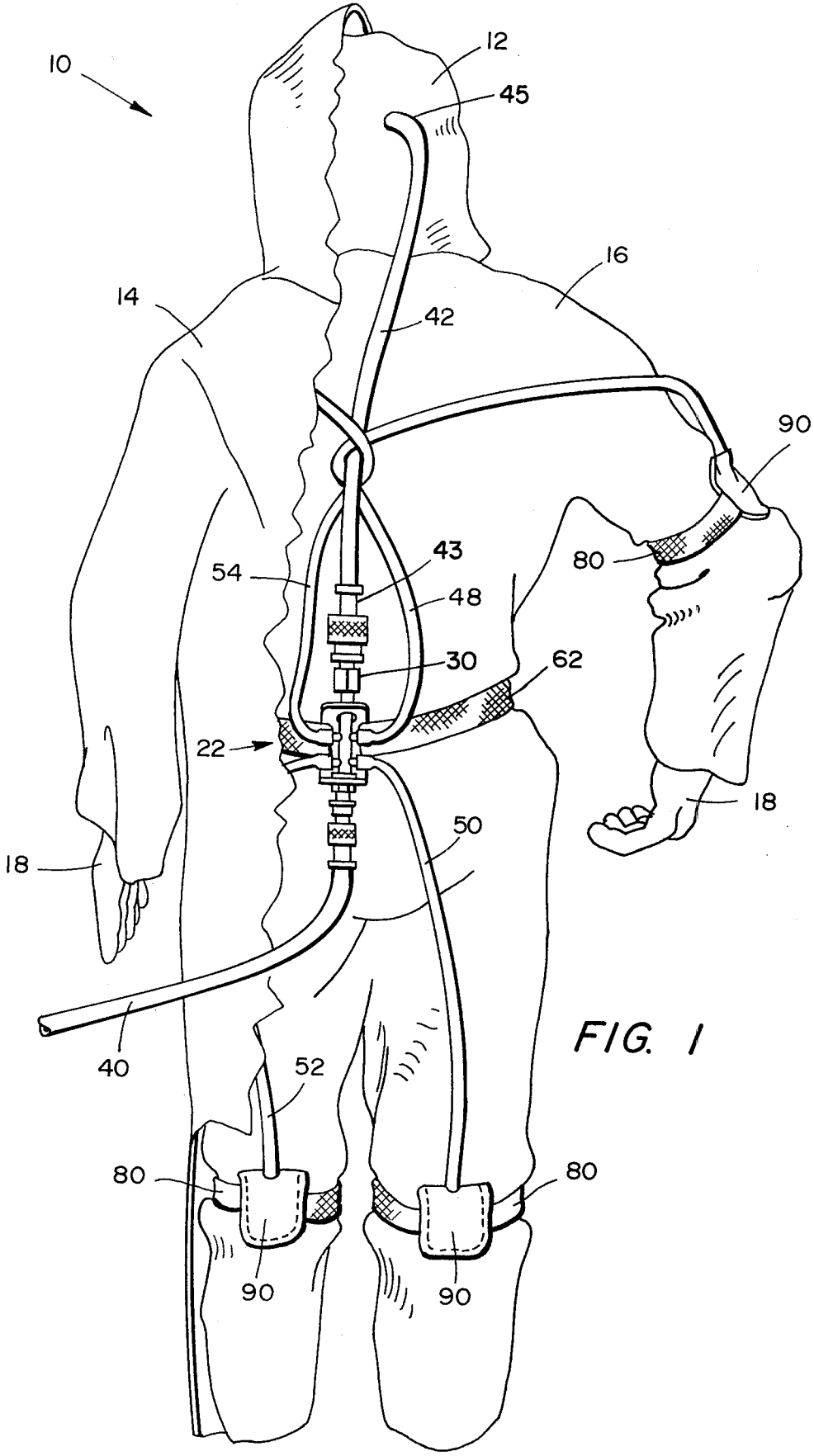
FIG. 1 is a perspective view of an embodiment of the present invention positioned upon a user's body taken from the rear, showing the user's body protectively clothed by a head enclosure and an outer covering which covers the user's trunk and limbs, the outer covering being partially broken away.

FIG. 1 illustrates a ventilating system according to a preferred embodiment of this invention, denominated generally as ventilating system 10. The ventilating system 10 according to this embodiment is useful in combination with protective clothing of the type including a head enclosure 12 and an outer covering 14 for a user's body.

The head enclosure 12 may be, for example, in the form of a flexible hood, as herein illustrated, or in the form of a rigid helmet. The head enclosure 12, in general, may be as disclosed by U.S. Pat. No. 4,052,984. The outer covering 14 may take the form of coveralls, such as are herein illustrated, and may be formed of materials which are either air permeable or air impermeable. The head enclosure 12 and outer covering 14 are preferably separate items of the protective covering. The outer covering 14 may be gathered about the user's ankles and wrists, but will allow escape of interior air therefrom. The outer covering 14 will normally be exterior an inner covering 16, or overalls, the ventilating system 10 being substantially disposed therebetween. The protective clothing may be completed by gloves 18 and boots (not shown).

As shown in FIG. 1, a hose 40 connects a pressurized air source (not shown) to a manifold 22. The hose 40 is preferably from about 10 to about 100 feet (30.5 to 305 meters) in length. According to Government regulations, an air flow of not less than 6 to not more than 15 cubic feet per minute must be delivered to the head enclosure 12. Thus, a first conduit 42 conducts air from the manifold to the head enclosure 12 in the required range of volume per unit time to provide a positive pressure or respiration air within the head enclosure 12. This insures that the wearer will have a constant supply of fresh air to breathe, and also prevents the entry of contaminated air into the head enclosure 12 by the flow therefrom.

Figure 2:
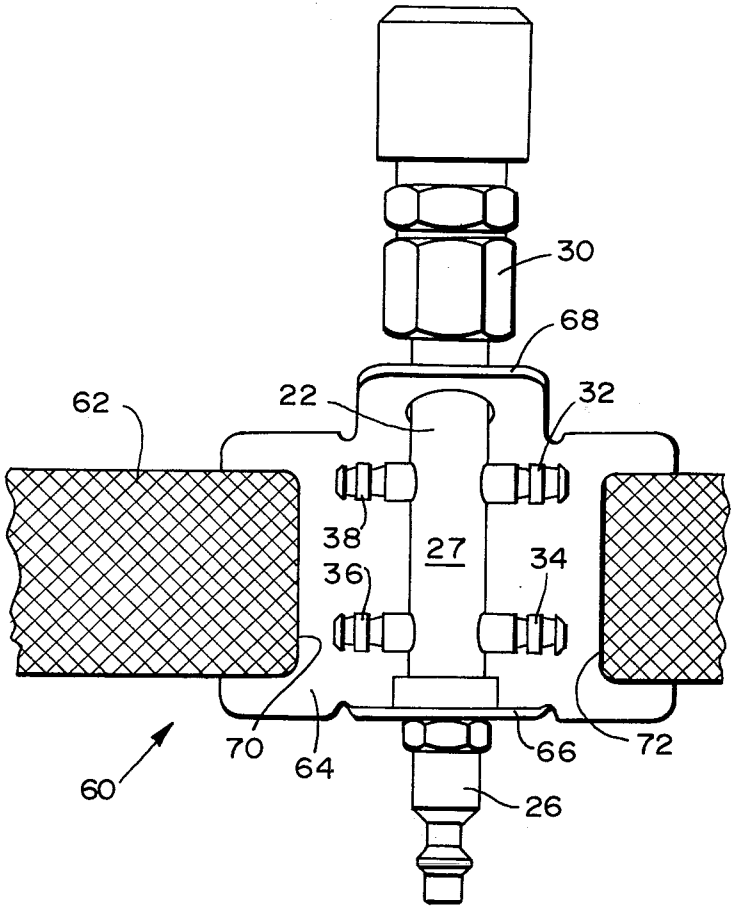
FIG. 2 is an exploded, plan view of a detail of the present invention.

FIG. 2 more clearly illustrates the manifold 22 according to the preferred embodiment of this invention. The manifold 22 comprises a chamber 27 having a cross-sectional area at least approaching the cross-sectional area of the hose 40. The chamber 27 is provided with an inlet 26 which is preferably a quick disconnect fitting for coupling the hose 40. The chamber 27 is also provided with a first outlet 30 which is preferably a quick disconnect fitting for coupling to the hose 42. Finally, the manifold is provided with a plurality of second air outlets 32, 34, 36 and 38. The second air outlets 32–38 include fittings each connectable to one end of a different one of a plurality of flexible second conduits 48, 50, 52 and 54, as best shown in FIG. 1. According to this embodiment of the invention, the first air outlet 30 is dimensioned with respect to the inlet 26 and second air outlets 32–38 such that when the air pressure at the source (not shown) is 25 pounds per square inch (gauge), the hose 40 is one hundred feet long and all of the second air outlets open to the atmosphere, an air flow of at least 6 cubic feet per minute is provided in the head enclosure 12 and when the hose 40 is ten feet long with all of the second air outlets 32–38 plugged, an air flow of not more than 15 cubic feet per minute is provided in the head enclosure 12 at an air pressure of 35 pounds per square inch gauge at the source. In a specific embodiment of the manifold according to this invention, the inlet hose 40 has an inner diameter of 0.375 inch, the chamber 27 has an inner diameter of 0.359 inch, the inlet 26 has an effective diameter of 0.187 inch, the first outlet 30 has an effective diameter of 0.187 inch and each of the second outlets has a diameter of 0.063 inch.

As best shown in FIG. 2, the manifold 22 preferably further includes a means 60 for releasably strapping the manifold body 22 to a user's trunk. The releasable strapping means 60 may comprise a belt 62, whose ends may be overlapped and fastened by conventional means, and a carrier member 64. The carrier member 64 may have loop portions 66 and 68, each loop portion for receiving a respective one of the air inlet 26 and the first outlet 30. The carrier member 64 extends outwardly from loops 66, 68 and includes a pair of longitudinally extending apertures 70, 72. The belt 62 may be threaded through apertures 70, 72. The carrier member 64 is preferably formed from a relatively inexpensive material which may be simply and rapidly cut by scissors. A suitable material is, for example, polyethylene.

Figure 3:
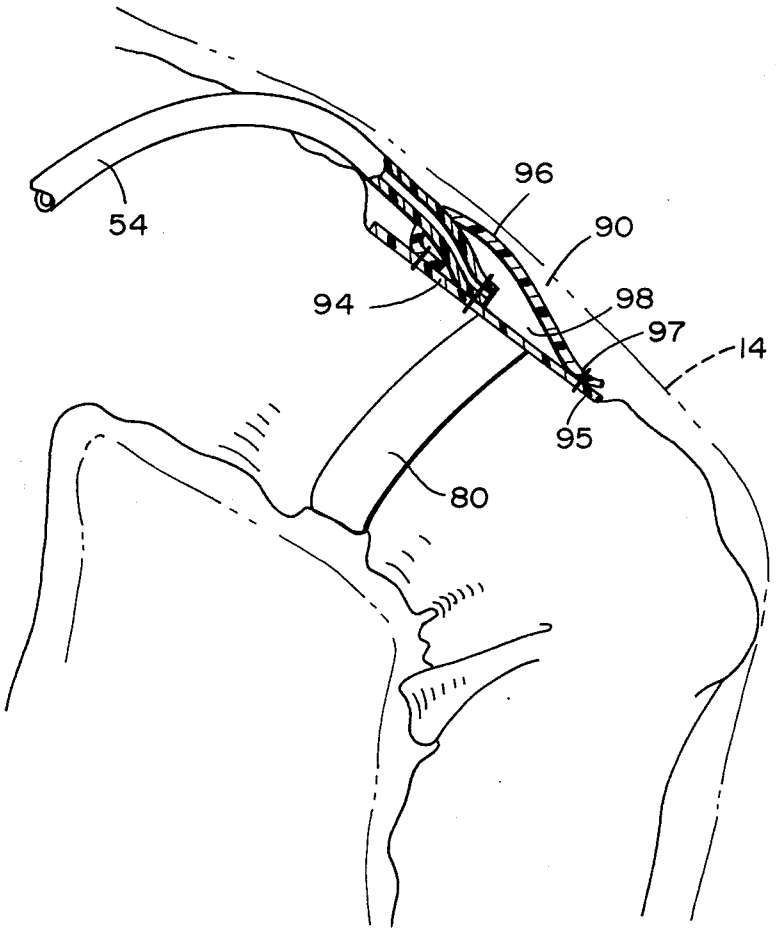
FIG. 3 is a side view partially in cross-section of a detail of the present invention.

Turning to FIG. 3, the ventilating system 10 further preferably comprises a means 80 for releasably connecting the other ends of the second conduits 48–54 to a user's limbs. The releasable connecting means 80 may simply be a strap formable into a bight, the bight being held by conventional releasable fastening means. An excellent releasable fastening means includes hook and loop type fasteners such as "Velcro" fasteners (available from Velcro, Inc., Manchester, N.H.).

The ventilating system 10 preferably further comprises a diffuser means 90 for releasing pressurized air interior to the outer covering 14 and for attenuating the sound thereof. The diffuser means 90 is carried at the other ends of each of the second circuits 48–54, FIG. 3 illustrates one of the diffusers 90, and is representative of each of the diffusers 90. Each of the diffusers 90 is formed of two layers 94 and 96. The layer 94 is of a non-porous material and the layer 96 is of a microporous material. A suitable non-porous material is, for example, polyethylene. A suitable microporous material is, for example, sintered vinyl of the type commercially available under the trademark "PORON", or a foamed vinyl on a knit backing, stretch fabric backing and the like. The layers 94, 96 are substantially overlapped one with the other, and may be fastened one to the other by conventional fastening means such as stitching, or fusion bonds formed by heat. The fastening will generally be about the peripheral edges 95, 97 of each of the layers, to form a cavity 98 therebetween. Each of the conduits 48–54 terminates a short distance after being sealed within the cavity 98 of a respective diffuser means 90, and the release of air therefrom is accomplished by diffusion through the micropores of the microporous layer 96; thus, sound due to air being released will tend to be attenuated within the means 90. Further, as illustrated by FIG. 3, the air being released by the releasing and attenuating means 90 tends to flow from the releasing point over the respective limbs and acts to cool the user's limbs. Also, a slight positive air pressure tends to be created interior the outer covering 14 which assists in retarding the entry of airborne contaminants through the outer covering 14 when air permeable material is used for the outer covering 14. Meanwhile, as previously discussed, pressurized air is being delivered within the predetermined range to the head enclosure 12.

In operation, a user may suit, work and de-suit with the ventilating system of the present invention as follows. The user normally will put on inner coveralls 16. The air hose 40 may be connected to the air inlet 26 of the manifold body 22. The pressurized air flowing from the air source (not shown) is adjusted to be within the air pressure range of about 25 to about 35 psig (about 172 to about 240 Pascals). The first conduit 42 is then connected at one end 43 to the first air outlet 30. The other end 45 of the first conduit 42 will normally have been previously connected to the head enclosure 12 so that the head enclosure 12 may simply be placed upon the user's head. Meanwhile, the manifold 22 is strapped to a central point 100 on the user's trunk. Each of the diffusers 90 is also strapped to the user's limbs, preferably with the non-porous layer 94 against the user's limbs and the microporous layer 96 outward therefrom. The outer covering 14, such as a pair of coveralls, is then put on (the air hose 40 being briefly disconnected from the quick-connection of air inlet 26), and the air hose 40 passed through a hole at the rear of the outer covering 14, reconnected, and the hole taped closed. Gloves and boots are then put on. The coveralls may be gathered about the user's ankles and wrists. The gloves and boots are normally taped to the inner coveralls 16. Thus suited, the user is assured of a constantly supplied and adequate amount of pure respiration air within the head enclosure 12 while the user's limbs are simultaneously ventilated. The protective clothing as above described, permits substantially complete freedom of movement for use, provides for comfortable wearing thereof, and protects the user against airborne contaminants.

The ventilating system of this invention is also useful with conventional clothing. For example, in welding operations, a ventilated head enclosure is usually worn together with a heavy coat and pants of ordinary type suitable for protection of the limbs and body of the welder from sparks and hot particles. On a warm summer day, the ventilating system of this invention can contribute greatly to the comfort of the welder in the performance of his work. Thus, the ventilating system of this invention can be adapted for a wide variety of uses without departing from the scope of the following claims.

What is claimed is:

1. In a ventilating system for use with protective body clothing of the type including an outer covering for the limbs of a user's body and a head protective enclosure, said ventilating system including a source of pressurized air, a manifold having an air inlet, a first air outlet connectable to said head protective enclosure and a plurality of second air outlets, a plurality of flexible conduits each connectable at one end to a different one of said plurality of second air outlets, the other end of each of said conduits being adapted for mounting on a different one of said limbs of said user's body interior of said outer covering; the improvement wherein:

said air inlet and said first air outlet of said manifold have effective diameters which are substantially equal to each other and said plurality of second air outlets each have an effective diameter less than said effective diameters of said air inlet and first air outlet of said manifold whereby pressurized air within a limited predetermined range of air volume per unit time is delivered from said first air outlet when said air inlet is connected to a source of pressurized air having a pressure within a given predetermined pressure range regardless of the connection of said flexible conduits to said second air outlets.

2. The improvement in a ventilating system as claimed in claim 1 wherein said plurality of flexible conduits comprise open ended air impervious tubes and further comprising:

means for releasably strapping said manifold to a user's trunk; and means for releasably connecting said other ends of said flexible conduits to said user's limbs.

3. The improvement in a ventilating system as claimed in claim 2 further comprising:

a plurality of diffusers for releasing pressurized air interior the outer covering while attenuating the sound thereof, each connected to said other end of a different one of said plurality of flexible conduits.

4. The improvement in a ventilating system as claimed in claim 3 wherein:

each of said diffusers is formed of two layers bonded to each other at their edges, one of said layers being of a non-porous material and the other of said layers being of a micro-porous material, said other end of one of said flexible conduits being located between said two layers and said non-porous layer being positioned adjacent said user's limb.

5. The improvement in a ventilating system as in claim 1 including means for providing pressurized air to said air inlet comprising an air hose having a length from about 10 feet to about 100 feet connected to a source of air at a pressure of from about 25 to about 35 psig; and wherein said first air outlet delivers pressurized air through said first conduit to the head enclosure within a range of not less than 6 to not more than 15 cubic feet per minute regardless of the connection of said flexible conduits to said second air outlets.

* * * * *